United States Patent [19]

Yokoi

[11] Patent Number: 4,650,963

[45] Date of Patent: Mar. 17, 1987

[54] CERAMIC GLOW PLUG

[75] Inventor: Shinichi Yokoi, Aichi, Japan

[73] Assignee: NGK Spark Plug Co., Ltd., Nagoya, Japan

[21] Appl. No.: 652,659

[22] Filed: Sep. 20, 1984

[30] Foreign Application Priority Data

Sep. 21, 1983 [JP] Japan ..... 58-173207
Sep. 21, 1983 [JP] Japan ..... 58-173208

[51] Int. Cl.[4] ..... H05B 3/00; F23Q 7/22; F02P 19/00

[52] U.S. Cl. ..... 219/270; 123/145 A; 219/544; 219/553; 361/266

[58] Field of Search ..... 219/260, 267, 270, 523, 219/541, 544, 522, 553; 123/145 R, 145 A, 179 H, 272; 361/264, 265, 266; 338/326, 330; 431/262

[56] References Cited

U.S. PATENT DOCUMENTS

| | | | |
|---|---|---|---|
| 2,030,937 | 2/1936 | Reichmann | 123/145 A |
| 2,482,551 | 9/1949 | Korsgren | 219/260 X |
| 4,211,204 | 7/1980 | Glanner et al. | 123/145 A |
| 4,345,555 | 8/1982 | Oshima et al. | 123/145 A X |
| 4,357,526 | 11/1982 | Yamamoto et al. | 219/544 |
| 4,359,977 | 11/1982 | Sperner et al. | 123/145 A |
| 4,401,065 | 8/1983 | Minegishi et al. | 123/145 A |
| 4,423,309 | 12/1983 | Murphy et al. | 219/270 |
| 4,425,692 | 1/1984 | Minegishi et al. | 219/270 X |
| 4,426,568 | 1/1984 | Kato et al. | 219/270 |
| 4,476,378 | 10/1984 | Takizawa et al. | 219/270 |
| 4,477,717 | 10/1984 | Walton | 219/267 |
| 4,502,430 | 3/1985 | Yokoi et al. | 123/145 A |

FOREIGN PATENT DOCUMENTS

| | | | |
|---|---|---|---|
| 3003799 | 2/1980 | Fed. Rep. of Germany | 123/145 A |
| 5726326 | 2/1982 | Japan | 219/270 |
| 254482 | 7/1926 | United Kingdom | 219/270 |
| 2013277 | 8/1979 | United Kingdom | 219/270 |
| 2027805 | 2/1980 | United Kingdom | 219/270 |

*Primary Examiner*—Anthony Bartis
*Attorney, Agent, or Firm*—Finnegan, Henderson, Farabow, Garrett & Dunner

[57] ABSTRACT

A ceramic glow plug includes an unjacketed ceramic heater formed by a coiled heating wire of a high melting point tungsten alloy having a specific resistance of at least 10 $\mu$ ohms/cm$^3$ embedded within a sintered ceramic body. The ceramic body has a diameter D of not more than 4.0 mm and is fitted into a hollow metallic cylinder with a tip portion thereof projecting less than three times its diameter D beyond a first axial end of the cylinder. The other end of the metallic cylinder is fitted into a mounting sleeve. The coiled portion of the heating wire is disposed substantially entirely within the projecting tip portion of the ceramic body. A resistor of iron or nickel wire may be positioned in the sleeve and connected in series with the heating wire for inhibiting overheating of the ceramic heater.

4 Claims, 8 Drawing Figures

CERAMIC GLOW PLUG

BACKGROUND OF THE INVENTION

The present invention relates to a ceramic glow plug to be fitted to a diesel engine mainly for the purpose of starting it, and more particularly, to a ceramic heater as a heating element of the glow plug.

In a diesel engine, to increase its starting performance, a glow plug is provided to a precombustion or swirl chamber, for example, and is made red-hot by passing electricity therethrough whereby when a fuel is injected into the chamber, part of the fuel is burned on coming into contact with the hot glow plug, thereby preheating the whole fuel. It is therefore required for the glow plug to have rapid heat-up characteristics at the time of starting. Furthermore, since there is a tendency that even after the starting the glow plug is used as an after glow for stabilization of combustion for long periods of time, it has been increasingly needed to increase the durability of the glow plug.

As a rapid heat-up type glow plug meeting the above requirements, a ceramic glow plug has heretofore been known in which a ceramic heater produced by embedding a heating wire made of a high melting point metal, tungsten (W), in powdered ceramic followed by sintering is used as a heating element. The structure of the ceramic glow plug is generally as shown in FIG. 1.

That is, a ceramic glow plug 1 comprises a ceramic heater 3 comprising a ceramic sintered body with a heating wire coil 2 embedded therein, a metallic external cylinder 4 in which the ceramic heater 3 is fitted and retained and to which one end of the heating wire coil 2 is electrically connected, a fitting metal 5 to which the metallic external cylinder 4 is brazed, thereby constituting a negative (−) electrode, and a center rod 6 electrically insulated from the fitting metal 5, to which the other end of the heating wire coil 2 is connected, thereby constituting a positive (+) electrode.

In conventional glow plugs having the structure as described above, the ceramic heater 3 is designed so that a heater part 3' in which the heating wire coil 2 is embedded and which becomes red-hot on passing electricity through the heating wire coil 2 extends beyond the edge of the metallic external cylinder 4. The projection length l is usually from 12 to 15 mm in the case where the battery voltage of a power source is 12 V. Since, however, the heater part 3' is fitted so that it is exposed in a combustion chamber, such as a swirl chamber, if the glow plug is designed with heater projection part 3' having a large outside diameter D to provide after glow for long periods of time, the exposed projecting portion prevents the formation of swirl in the chamber, thereby exerting adverse influences on combustion of the diesel fuel. This further gives rise to problems such as a reduction in engine output, a decrease in specific fuel consumption, and an increase in the amount of harmful exhaust gases. For this reason, it is preferred for the heater part 3' to be designed so that its external diameter D is as small as possible and the projection length l from the metallic external cylinder 4 is as short as possible.

When, however, the heater part 3 is reduced in its external diameter D, it is easily broken by the severe heat cycling, rapid heating and rapid cooling, in the chamber and vibration, impact and so forth to which it is exposed during driving. That is, a mechanical strength problem as described above is encountered in decreasing the external diameter D of the heating part 3'. In order to overcome the above problem, a glow plug as shown in FIG. 2 (in which the same parts as in FIG. 1 are indicated by the same symbols) has been proposed in which the metallic external cylinder 4 holding the heater part 3' is increased in length, thereby decreasing the projection length $l_1$ and reinforcing the heater part 3'. In this glow plug, however, a portion of the heating wire coil 2, corresponding to the length $l_2$ as shown in FIG. 2 is covered with the metallic external cylinder 4 and, therefore, a heat-generation efficiency is reduced. Moreover, the temperature of the above-defined portion of the heating wire coil 2 rises excessively, causing a problem that a brazing material used in connecting the metallic external cylinder is melted. If the projection length of the heater part is merely shortened without changing the material and wire diameter of the heating wire, the heating wire coil embedded in the heating part is inevitably shortened. This leads to a reduction in resistance value and causes a problem that the necessary amount of heat cannot be generated.

SUMMARY OF THE INVENTION

The present invention is intended to overcome the above-described problems.

An object of the present invention is to provide a ceramic glow plug in which a heater part is miniaturized by using a tungsten alloy wire having a greater specific resistance than the conventionally used pure tungsten (W) wire and a combination as described hereinafter as a heating wire of a ceramic heater, and which is superior in heat-generation performance and durability.

Another object of the present invention is to provide a ceramic heater which is superior in starting performance and has increased durability. In this case, the external diameter of the ceramic heater is reduced, and a heating wire coil is disposed so that the projection length is within a predetermined range, by dividing the voltage between the heating wire coil and a non-coil portion of the heater. In the heating wire coil of the ceramic heater, a tungsten alloy having a greater specific resistance than conventionally used pure tungsten or pure tungsten wires and a combination as described hereinafter is used to thereby miniaturize the heater part. In this ceramic heater, a resistor made of a material having a greater temperature-resistance coefficient ratio (a ratio of the resistance value at 1000° C. to the resistance value at room temperature than the material used in the above-described heating wire coil is used in combination and connected in series, whereby the amount of electricity passed at the time of rapidly raising the temperature is controlled and overheating of the heater part is prevented.

BRIEF DESCRIPTION OF THE DRAWINGS

In the accompanying drawings

DETAILED DESCRIPTION OF THE PREFERRED EMBODIMENTS

The present invention will hereinafter explained in detail with reference to accompanying drawings.

Figure 1:
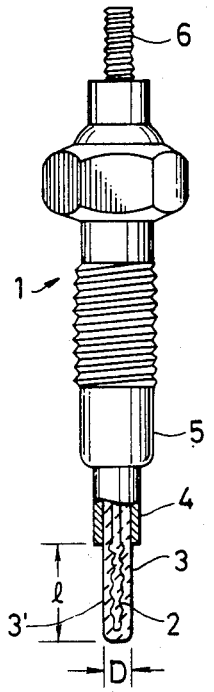
FIG. 1 PRIOR ART
FIG. 1 is a front view of a conventional ceramic glow plug.
Figure 2:
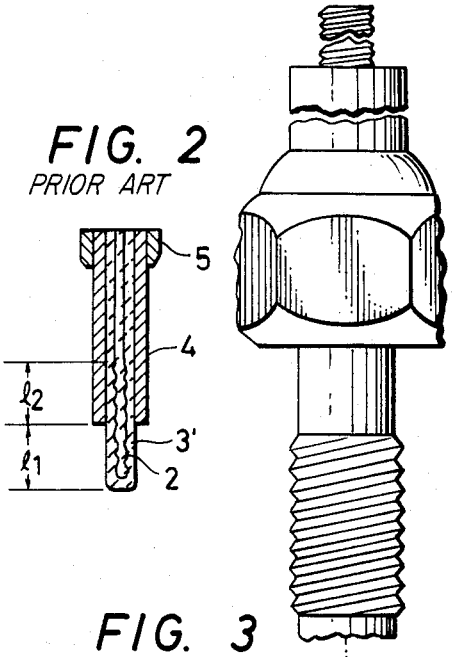
FIG. 2 PRIOR ART
FIG. 2 is a longitudinal-sectional view showing a known variation wherein the heater part of a conventional glow plug is reinforced by increasing the length of a metallic external cylinder without changing the conventional structure.
Figure 3:
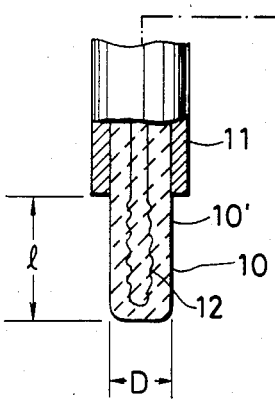
FIG. 3 is a longitudinal-sectional view showing the structure of a heater part in a ceramic glow plug of the present invention.

FIG. 3 is a longitudinal-sectional view of the main part of a ceramic heater in a ceramic glow plug (first invention) of the present embodiment.

A ceramic heater 10 is fitted through a metallic external cylinder 11 and retained therein. A heater part 10' of the ceramic heater 10 extends beyond the tip end of the metallic external cylinder 11. A heating wire coil 12 is embedded within the heater part 10' having a projection length l. This heating wire coil 12 is made of a material having a greater specific resistance (10 $\mu\Omega$-cm$^3$ or more) than pure tungsten (specific resistance, 5.0 $\mu\Omega$-cm$^3$), i.e., a tungsten alloy comprising tungsten and at least one of rhenium, thorium, and zirconium, whereby the heating wire coil 12 may be miniaturized in physical size. Thus, the heater part 10' is formed in such a small size that the external diameter D (defined to be the long diameter when the cross section is not circular but oval); is not more than about 4.0 mm and the projection length l is not more than 3 times the external diameter D. Parts other than the ceramic heater of the ceramic glow plug of the present invention have structures similar to corresponding parts in conventional glow plugs. Thus, explanation for these parts has been omitted.

Figure 4:
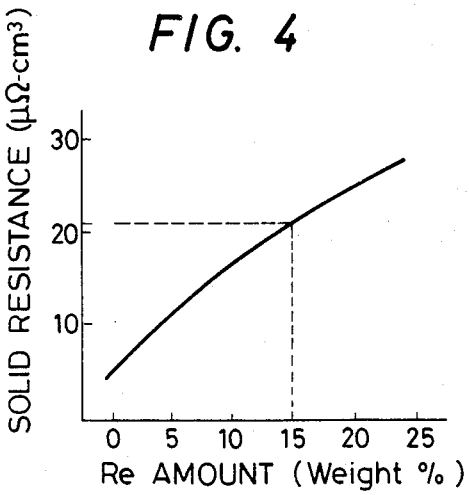
FIG. 4 is a graph showing a relation between the amount of rhenium added and specific resistance for a tungsten alloy used in a heating wire of the present invention.

FIG. 4 is a graph showing a relation between the amount of rhenium added in the range of from 5 to 30% by weight based on the weight of tungsten and the specific resistance of the resulting tungsten-rhenium alloy wire. As can be seen from the graph, when the amount of rhenium added is 15% by weight, the specific resistance of the resulting tungten-rhenium alloy wire is about 21 $\mu\Omega$-cm$^3$. When this alloy wire is used as a heating wire for a 12 V ceramic heater, the effective length of the heating wire coil can be reduced to about half the conventional one. Thus there can be obtained a ceramic glow plug in which the projection length of the heater part is reduced to about half the conventional one.

In the ceramic glow plug of the present invention, the external diameter D of the ceramic heater is not more than 4.0 mm and the projection length l is not more than 3 times the external diameter D. This is based on the results of rapid electric heating tests and drop impact tests of a ceramic glow plug of the present invention in which a tungsten-rhenium alloy wire is used as a heating wire.

Figure 5:
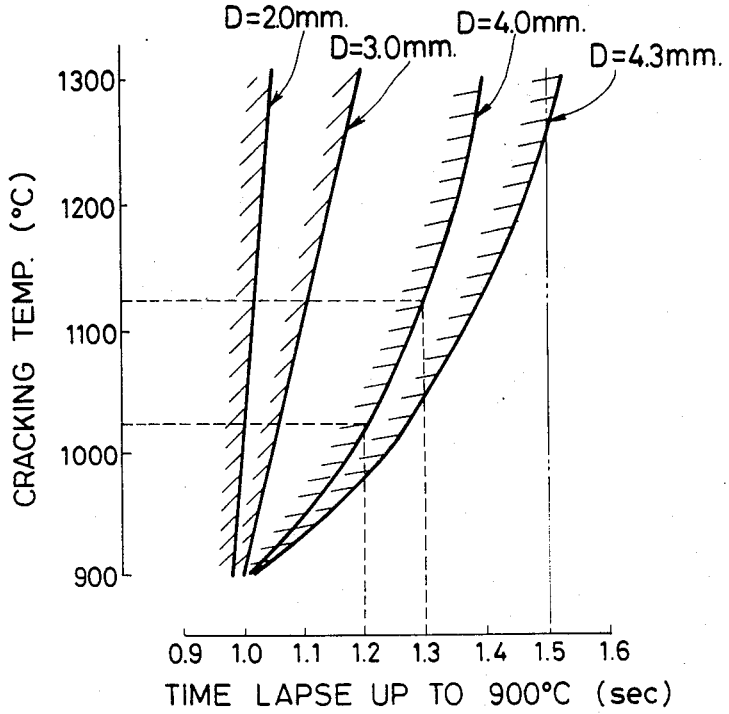
FIG. 5 is a graph showing a relation between a temperature-rising time up to 900° C. and a critical temperature at which cracking of ceramic occurs at different varied heater external diameters.

FIG. 5 is a graph showing the results of the rapid electric heating test. Four glow plugs with ceramic heaters having different external diameters, 2.0 mm, 3.0 mm, 4.0 mm, and 4.3 mm, were heated under varied temperature-rising conditions up to 900° C. and further up to a maximum temperature of 1,300° C. That is, FIG. 5 is a graph showing a relation between a temperature-rising time up to 900° C. (a time required until the ceramic heater is heated to 900° C.) and a temperature at which cracking of the ceramic occurs. A hatched area at the left side of each curve indicates a zone where cracking of the ceramic occurs. In the case of a curve (external diameter (D)=4.0 mm), for example, if the temperature-rising time is less than 1.4 seconds, the ceramic is cracked when it is heated to about 1,300° C. If the temperature-rising time is less than 1.3 seconds, the ceramic cracking occurs when the ceramic heater is heated to about 1,125° C., and if the temperature-rising time is less than 1.2 seconds, the ceramic cracking occurs when the ceramic heater is heated to about 1,025° C. It can be seen from the graph that as the external diameter (D) is reduced, the temperature-rising time up to 900° C. can be shortened, whereas as the external diameter (D) is increased, a time lag in rise of temperature between the heating wire and the ceramic increases, resulting in the formation of a heat strain; that is, the ceramic cracking easily occurs due to the heat strain, indicating that the temperature-rising time up to 900° C. is difficult to shorten. Accordingly, it can be seen that to satisfy the requirement that the temperature-rising time up to 900° C. should be less than 1.5 seconds to obtain good starting performance and combustion stability, it is desirable to decrease the external diameter (D) of the ceramic heater to not more than 4.0 mm.

Figure 6:
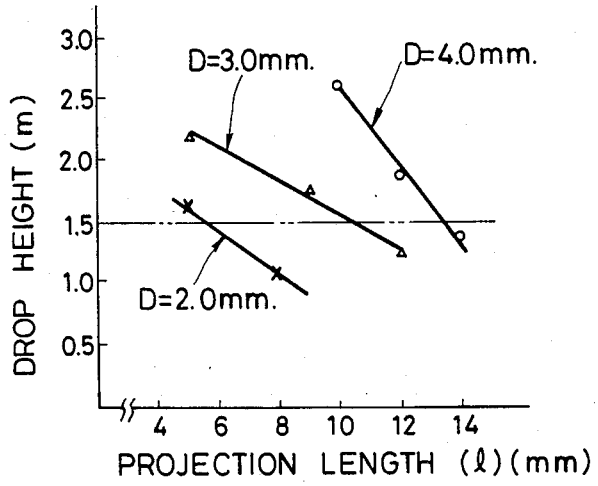
FIG. 6 is a graph showing a relation between a projection length and a dropping height.

FIG. 6 is a graph showing the results of the drop impact test. In this test, three ceramic glow plugs with ceramic heaters having different external diameters, 2.0 mm, 3.0 mm, and 4.0 mm, were used. Each sample was held horizontally and dropped on a concrete floor. That is, FIG. 6 is a graph showing a relation between the height at which the ceramic heater is broken when the ceramic glow plug is dropped and the projection length (l) of the ceramic heater. From a practical viewpoint, it is necessary that the ceramic glow plug be not broken even when dropped from a height of more than 1.5 m. For this purpose, it can be seen from the FIG. 5 that the projection length (l) of the ceramic heater must be controlled to not more than 3 times the external diameter.

Figure 7:
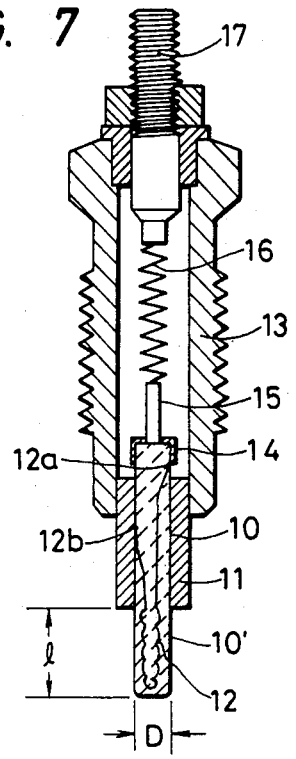
FIG. 7 is a longitudinal-sectional view of another ceramic glow plug of the present invention.

FIG. 7 is a longitudinal sectional view of a ceramic glow plug of the present invention (second embodiment). A heater part 10' of a ceramic heater 10 extends beyond the top end of a metallic external cylinder 11. A heating wire coil 12 embedded in the heater part 10' is made of a tungsten alloy comprising tungsten and at least one of rhenium, thorium, zirconium, cobalt, and molybdenum and having a such positive temperature-resistance coefficient that the temperature-resistance coefficient measured at 1000° C. is not more than 4 times that at room temperature. The ceramic heater 10 is formed so that the external diameter D (when the cross section is not circular but oval, D is the long diameter is not more than 4.0 mm and the projection length l of the heater part 10' from the tip end of the metallic external cylinder is not more than 3 times the external diameter D. The above structure of the second invention is the same as that of the first embodiment for the reasons as described above.

The ceramic heater 10 is fitted through the metallic external cylinder 11 and bonded thereto. One end **12*a* of a heating wire coil 12 embedded in the ceramic heater 10 is connected to the metallic external cylinder 11. The metallic external cylinder 11 is further brazed to a metal fitting 13**. In this way, a negative (−) electrode is constituted.

On the other hand, the other end **12*b* of the heating wire coil 12 is connected to a metallic cap 14 placed on and fixed to the rear end of the ceramic heater 10, and further to a resistor 16 through a lead wire 15 brazed to the metallic cap 14. The other end of the resistor 16 is connected to a central rod 17. In this way, a positive (+) electrode is constituted. The resistor 16** is made of a metal having a such positive resistance-temperature coefficient that the temperature-resistance coefficient measured at 1000° C. is not less than 5 times that at room temperature. Examples of the metal are tungsten, molybdenum, nickel and iron.

The resistance values of the heating wire coil 12 and the resistor 16 are determined depending on the necessary heating conditions.

Figure 8:
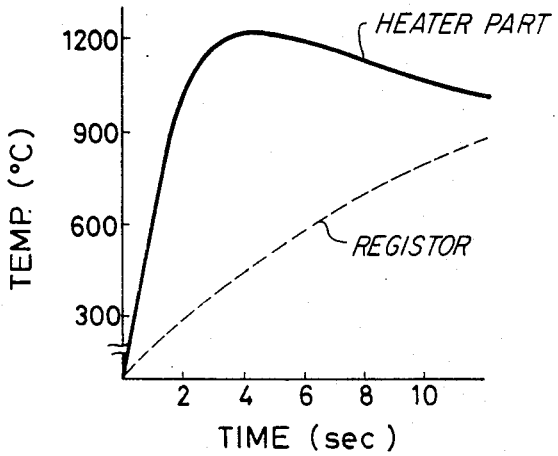
FIG. 8 is a graph showing a relation among an electricity-passing time for increasing temperature, a temperature of a heater part, and a temperature of a resistor for the ceramic glow plug of FIG. 7.

A ceramic glow plug of the second embodiment (heater external diameter D=3 mm, projection length l=5 mm) was rapidly raised in temperature by passing electricity. FIG. 8 is a graph showing a relation among a time for which electricity is passed, a temperature of the heater part in which the heating wire coil is embedded, and a temperature of the resistor. The following are apparent from the graph. That is, since the heating wire coil embedded in the heater part is made of a tungsten alloy having a small temperature-resistance coefficient ratio (defined as a temperature-resistance coefficient measured at 1000° C. not more than 4 times that at room temperature), the resistor is made of a metal having a large temperature-resistance coefficient ratio (defined as the temperature-resistance coefficient measured at 1000° C. not less than 5 times that at room temperature), and the heating wire coil is connected in series to the resistor, the resistance value of the resistor increases more rapidly than that of the heating wire coil at the time of rapidly raising temperature caused by passing electricity. As a result, the resistor reduces the heating current by self control and greatly but efficiently inhibits the overheating of the heating wire coil, i.e., the heater part. The heating wire coil is not limited to the above embodiment alone. Even when the heating wire coil is made of a conventional tungsten molybdenum material, if the resistor is made of a nickel iron material having a particularly high resistance-temperature coefficient, the object of the present invention can be attained.

In the ceramic glow plug (first embodiment) of the present invention, the heating wire of the ceramic heater is made of a tungsten alloy material having a greater specific resistance than a conventionally used pure tungsten material. As a result, a heating wire coil is miniaturized and thus the projection length of a heater part can be shortened. This short heater part rarely inhibits the formation of swirl in a combustion chamber, and its mechanical strength against vibration, impact, and so forth during driving is increased. That is, there can be obtained a ceramic glow plug which is freed of the problems of the prior art and is superior in durability and heating performance.

In the ceramic glow plug (second embodiment) of the present invention, the voltage across the plug is divided between the heating wire coil of the ceramic heater and a series-connected resistor wire and the heating wire is made of pure tungsten or a tungsten alloy material having a greater specific resistance than a conventionally used pure tungsten material. As a result, the heating wire coil is miniaturized and thus the projection length of the heater part can be shortened. This short heater part rarely inhibits the formation of swirl in a combustion chamber, and its mechanical strength against vibration, impact, and so forth during driving can be increased. Furthermore, the ceramic heater is connected in series to a resistor made of a metal material having a greater temperature-resistance coefficient than the heating wire embedded in the heater part of the ceramic heater. When, therefore, the ceramic plug is rapidly raised in temperature, the resistance value of the resistor increases more rapidly than that of the heating wire coil, thereby reducing the heating current. As a result, the overheating of the heater part is inhibited, and the cracking of ceramic due to heat impact and the breakage of the heating wire coil can be prevented. That is, there can be obtained a ceramic glow plug which is freed of the problems of the prior art and is improved in the starting performance of an engine and increased in durability.

What is claimed is:

1. A ceramic glow plug comprising:

an unjacketed ceramic heater including a sintered ceramic body and a heating wire of a high melting point tungsten alloy having a specific resistance of at least 10 $\mu\Omega$-cm$^3$, said heating wire having a coil portion embedded in said sintered ceramic body, said heating wire having terminal ends extending outside said ceramic body; a hollow metallic external cylinder through which the ceramic heater is fitted, a tip portion of said heater projecting beyond a first axial end of the metallic external cylinder; a metallic mounting sleeve into which the other axial end of the metallic external cylinder is fitted, the external diameter D of the ceramic heater tip portion being less than 4.0 mm, the projection length of the tip portion measured from said first axial end of the metallic external cylinder being less than 3 times its external diameter D, and the coil portion of the embedded heating wire being disposed substantially entirely within the projection length.

2. The ceramic glow plug as claimed in claim 1, wherein the tungsten alloy comprises tungsten and at least one of rhenium, thorium, and zirconium.

3. The ceramic glow plug as in claim 1 wherein a resistor is connected in series with the heating wire of the ceramic heater, said resistor being positioned within the inside of the metallic sleeve, and said resistor having a positive temperature-resistance coefficient.

4. The ceramic glow plug as in claim 3 wherein the resistor is made from a wire material selected from the group consisting of iron and nickel wire material.

* * * * *